United States Patent [19]

Inque et al.

[11] 4,035,244

[45] July 12, 1977

[54] ELECTRIC RECORDING PROCESS

[75] Inventors: Eiichi Inque; Hiroshi Kokado, both of Tokyo; Nobuhiro Miyakawa, Kobe, all of Japan

[73] Assignee: Mita Industrial Company Limited, Japan

[21] Appl. No.: 626,918

[22] Filed: Oct. 29, 1975

[30] Foreign Application Priority Data

Nov. 1, 1974 Japan ..... 49-125501

[51] Int. Cl.$^2$ ..... C25D 17/10; C25D 11/00

[52] U.S. Cl. ..... 346/165; 204/2

[58] Field of Search ..... 204/2, 195 S, 15, 18 PC; 346/74 E

[56] References Cited

U.S. PATENT DOCUMENTS

| | | | |
|---|---|---|---|
| 3,403,090 | 9/1968 | Tajiri et al. | 204/195 S |
| 3,578,578 | 5/1971 | Krusenstierna | 204/195 S |
| 3,713,996 | 1/1973 | Letter | 204/2 |
| 3,753,869 | 8/1973 | Ambrosia et al. | 204/2 |
| 3,864,684 | 2/1975 | Shimuzu | 204/2 |
| 3,951,757 | 4/1976 | Yoshino | 204/2 |

*Primary Examiner*—T. M. Tufariello

*Attorney, Agent, or Firm*—Wenderoth, Lind & Ponack

[57] ABSTRACT

An electric recording process comprising applying electricity to an anode of a solid electrolyte, said electrolyte being a Group IB metal compound having an ionic conductivity of at least $1 \times 10^{-4}\ \Omega^{-1}\ cm^{-1}$ under application conditions. Said anode is contacted with a recording layer containing color forming agent capable of reacting with ions of said metal of Group IB of the Periodic Table to form a visible image.

20 Claims, 19 Drawing Figures

Fig. 1-A
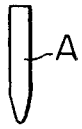
Fig. 1-B
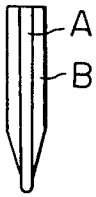
Fig. 1-C
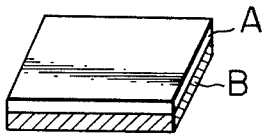
Fig. 1-D
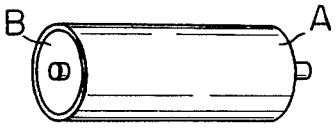
Fig. 1-E
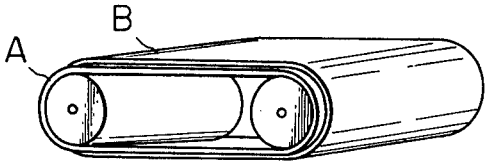
Fig. 1-F
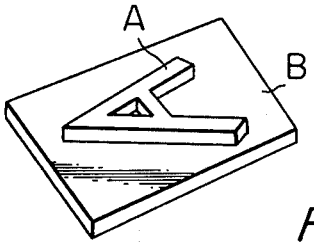
Fig. 1-G
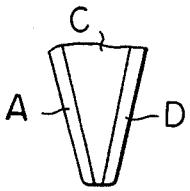
Fig. 1-H
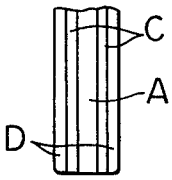

0.8
0.7
0.6
0.5
0.4
0.3
0.2
0.1
0
IMAGE DENSITY
Ag3SI
Ag
0
50
100
APPLIED VOLTAGE (V)

Fig. 11
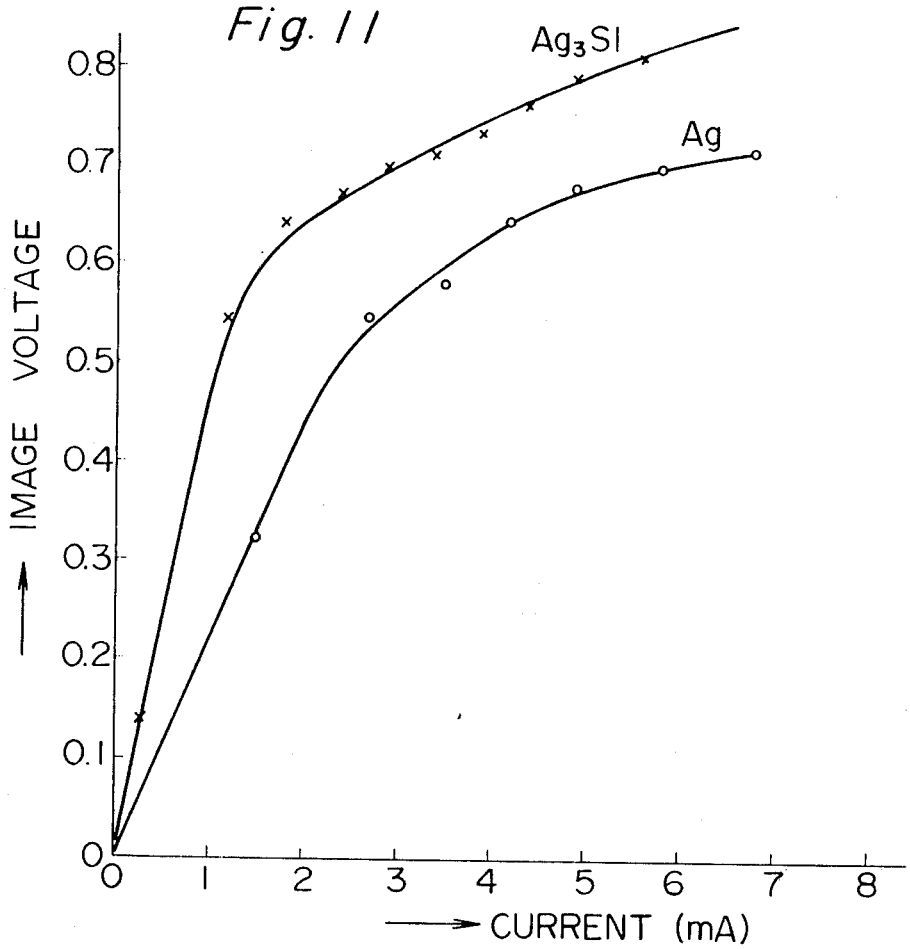
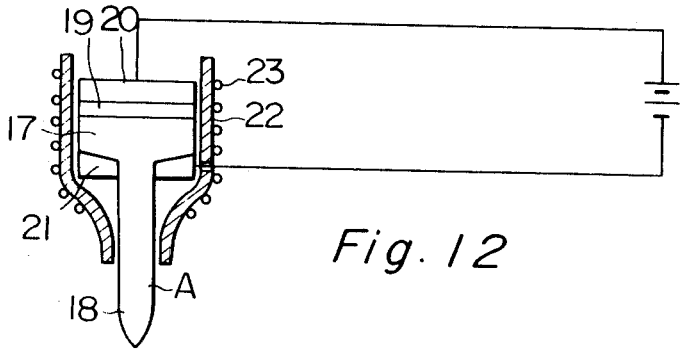
Fig. 12

ELECTRIC RECORDING PROCESS

This invention relates to a novel electric recording process. More particularly, the present invention relates to an electric recording process in which electricity is applied to an anode of a solid electrolyte, which electrolyte is a compound of a metal of Group IB of the Periodic Table. The electrolyte has an ionic conductivity of at least $1 \times 10^{-4}\ \Omega^{-1}cm^{-1}$ under application conditions. Said anode is then in the state contacted with a layer of a color forming agent capable of reacting with ions of said Group IB metal compound to form a visible image. Furthermore, the present invention relates to a novel electrode for use in practising this electric recording process.

Conventional electric recording processes using the ionic reaction of an electrode include those in which an electrode of iron, copper or the like is used in combination with a recording paper in which a color forming agent such as diethyl dithiocarbamate, rubeanic acid or the like has been incorporated and an electric current is flows to this recording paper to form a colored image. Another conventional process is one in which a silver anode is used in combination with a recording paper containing a reducing agent and silver ions are released from the anode by application of electricity and are reduced to form a visible image of metallic silver on the recording paper.

These recording processes using ionic reaction of an electrode are advantageous in that colored images can be obtained without conducting such treatments as development and the structure of the recording mechanism is relatively simple. However, these recording processes have various defects inherent of ionic reaction of an electrode.

More specifically, in these recording processes, it is necessary that an electrode-forming metal be released on a recording paper in the form of an ion (cation), and therefore, a large quantity of electric power is often required for recording. Further, no satisfactory effects are generally obtained unless a recording paper is kept in the wet state. Accordingly, conventional recording papers are generally wetted so that recording can be accomplished even when the relative humidity is about 40%, and hence, if recording papers are exposed to the atmosphere for a long time, satisfactory recording is impossible with use of such recording papers. In order to overcome this disadvantage, it is necessary to adopt special means. For example, it is necessary to keep the recording paper-containing zone air-tight.

In view of the foregoing state of the art, we conducted research with a view to developing a material capable of releasing metal ions effectively on a recording paper under application of a recording current, and as a result, we found that a Group 1B metal compound solid electrolyte having the above-mentioned characteristics has a peculiar property of releasing metal ions under application of a recording electric power of relatively low voltage and relatively small current and that the foregoing defects involved in conventional recording processes using ionic reaction can be effectively moderated if this solid electrolyte is applied to electrolytic recording. We have now completed the present invention based on these findings.

More specifically, in accordance with the fundamental aspect of the present invention, there is provided an electric recording process comprising applying electricity to an anode of a Group 1B metal compound solid electrolyte having an ionic conductivity of at least $1 \times 10^{-4}\ \Omega^{-1}cm^{-1}$ under application conditions. Said anode is then contacted with a recording layer containing color forming agent capable of reacting with ions of said metal of Group IB of the Periodic Table to form a visible image.

In the present invention, a Group IB metal compound solid electrolyte of is used to form an anode shaped as a needle, a pen, a drum or a coated layer. When electrolytic recording is conducted with use of this anode, there can be attained various advantages in connection with ease of recording, recording efficiency and the like.

More specifically, since metal ions of the solid electrolyte are directly released by ionic conduction and not by ionic reaction, recording can be accomplished with a smaller current and lower voltage, namely under application of a lower electric power, than in conventional electric recording processes.

Further, even when the concentration of a color forming agent in a recording paper to which metal ions are to be directly released by ionic conduction is low, formation of an image, namely recording, can be accomplished assuredly. Therefore, it is quite unnecessary to adopt a troublesome method in which recording papers are always stored and contained in sealed vessels or containers. Thus, according to the present invention, the recording operation can be much simplified over the conventional electrolytic recording processes.

Still further, according to the present invention, it is made possible to supply an ion current of a much higher concentration onto a recording paper than in the conventional electrolytic recording processes, and therefore, an image of a higher density can be obtained by recording. Since the image density is in inverse proportion to the scanning speed in the recording step, the recording speed can be highly improved over the conventional processes, when it is intended to obtain images of the same density. In addition, in the present invention, since metal ions are directly supplied to the surface of a recording paper, bleeding can be greatly reduced in the resulting image as compared with the conventional processes.

Moreover, an anode composed of the above-mentioned solid electrolyte can readily be injected with ions or regenerated by various methods described hereinafter, and hence, the troublesome operation of exchange of anodes can be omitted in the present invention.

This invention will now be described in detail.

In practising the electrolytic recording process of the present invention, a solid electrolyte of a metal of Group IB of the Periodic Table having an ionic conductivity of at least $1 \times 10^{-4}\ \Omega^{-1}cm^{-1}$ under application conditions is used as an anode.

It has heretofore been believed that the ionic conductivity of a solid electrolyte is due to lattice defects of a crystal because in a complete crystal constituent ions are not allowed to migrate at all. A high ionic conductivity of $\alpha$-$Ag_2HgI_4$, for example, is owing to its special crystal structure, namely the average structure, and since two silver ions and one mercury ion are distributed uniformly on the average in equivalent 4 lattice points, one cation-vacant lattice point is left and conduction can readily be caused because of the presence of this vacant lattice point. Further, $\alpha$-AgI has a typical average structure in which 2 silver atoms are statistically dispersed at points 42 around the body-centered cubic arrangement of iodine atoms, and the silver atom acts as if it were a solution and hence, a very high ionic conductivity is manifested.

As is seen from the foregoing description, the conductivity of a solid electrolyte is closely concerned with the crystal structure thereof, and a compound having an average structure as mentioned above has an especially high ionic conductivity. In the present invention, in view of the foregoing fact, a Group IB metal compound solid electrolyte is chosen and used as an anode.

In the present invention, it is important the Group IB metal compound solid electrolyte to be used have an ionic conductivity of at least $1 \times 10^{-4}\ \Omega^{-1}cm^{-1}$, preferably at least $1 \times 10^{-3}\ \Omega^{-1}cm^{-1}$. Solid electrolytes of compounds of metals of Group IB of the Periodic Table are divided into two types, one having an ionic conductivity of at least $1 \times 10^{-3}\ \Omega^{-1}cm^{-1}$ even at room temperature and the other having an ionic conductivity of at least $1 \times 10^{-3}\ \Omega^{-1}cm^{-1}$ only at high temperatures, especially at temperatures higher than the transition point. In the present invention, solid electrolytes of the former room temperature type are preferably employed because of facilitation of the recording operation, but solid electrolytes of the high temperature type can also be used in the present invention and good results ca be obtained, as far as the transition point is lower than 200° C., preferably lower than 150° C.

Accordingly, the term "under application conditions" used in the instant specification and claims includes not only the case where an anode of the solid electrolyte is used at room temperature but also the case where this anode is heated at a temperature lower than 200° C., preferably at a temperature lower than 150° C. A solid electrolyte having an ionic conductivity of at least $1 \times 10^{-4}\ \Omega^{-1}cm^{-1}$, preferably at least $1 \times 10^{-3}\ \Omega^{-1}cm^{-1}$, is chosen and used in the present invention.

As the solid electrolyte that can be used in the present invention, there can be mentioned, for example, halides, especially iodides, of metals of Group IB of the Periodic Table, especially silver and copper; chalcogenides of these metals, especially sulfides; selenides and tellurides, solid solutions thereof; and solid solutions of the foregoing materials with mercury iodide, iron sulfide, other metal halides, other chalcogenides, or tungstates, phosphates, pyrophosphates or other salts of metals of Group IB of the Periodic Table Examples of solid electrolytes that are preferably employed in the present invention are described below. In the case of electrolytes of the high temperature type, the transition point and the ionic conductivity at the transition point are also shown.

a. Silver Type Ionic Conductive Solid Electrolytes:

$\alpha$-AgI (transition point = 147° C.): 5 to 6 $\Omega^{-1}cm^{-1}$ $\alpha$-$Ag_2S$ (transition point = 180° C.): 3 $\Omega^{-1}cm^{-1}$ $\alpha$-$Ag_2Se$ (transition point = 133° C.): 4 $\Omega^{-1}cm^{-1}$ $\alpha$-$Ag_2Te$ (transition point = 145° C.): 1 $\Omega^{-1}cm^{-1}$ $Ag_3SBr$: $2 \times 10^{-3}\ \Omega^{-1}cm^{-1}$ at 25° C.

$Ag_3SI$: $1 \times 10^{-2}\ \Omega^{-1}cm^{-1}$ at room temperature $\alpha$-$Ag_2HgI_4$ (transition point = 50° C.): $1 \times 10^{-3}\ \Omega^{-1}cm^{-1}$ $Ag_6I_4WO_4$: $4.7 \times 10^{-2}\ \Omega^{-1}cm^{-1}$ at 25° C.

$PbAg_4I_5$: 1.2 to $2.5 \times 10^{-1}\ \Omega^{-1}\ cm^{-1}$ at room temperature $Ag_2Hg_{0.25}S_{0.5}I_{1.5}$: $6 \times 10^{-2}\Omega^{-1}cm^{-1}$ at room temperature $Ag_4HgSe_2I_2$: about $1.5 \times 10^{-2}\ \Omega^{-1}cm^{-1}$ at 20° C.

$Ag_2S(0.70)$—$HgI_2(0.30)$: $3 \times 10^{-3}\ \Omega^{-1}cm^{-1}$ at 25° C.

$Ag_2s(0.60)$—$HgI_2$( 0.40 ): 5 to $6 \times 10^{-3}\ \Omega^{-1}cm^{-1}$ at room temperature $Ag_2Te_{0.2}S_{0.8}$: $2.3 \times 10^{-1}\ \Omega^{-1}\ cm^{-1}$ at 25° C.

$Ag_7I_4PO_4$: $1.9 \times 10^{-2}\ \Omega^{-1}\ cm^{-1}$ 25° C.

$Ag_{19}I_{15}P_2O_7$: $9 \times 10^{-2}\ \Omega^{-1}\ cm^{-1}$ at 25° C.

$Ag_2S(0.69)$-$Ag_{1.70}Te(0.285)$-$Ag_4P_2O_7(0.025)$: $2.4 \times 10^{-1}\ \Omega^{-1}cm^{-1}$ at 20° C.

$Ag_2Te$-AgI-$HgI_2$ system as $Ag_2Te(0.35)$-$AgI(0.40)$-$HgI_2(0.25)$, $Ag_2Te(0.40$ $AgI(0.80)$-$Ag_2Cr_2O_7(0.20)$: $1.1 \times 10^{-2}$ $\omega 6$ $cm^{-1}$ at room temperature (b) Copper Type Ionic Conductive Solid Electrolytes:

$\alpha$-$Cu_2Se$ (transition point =110° C.):

$\alpha$-$Cu_2HgI_4$ (transistion point = 65' C.): $1 \times 10^{-3}\ \Omega^{-1}\ cm^{-1}$ $Cu_5FeS_4$:

In the present invention, it is generally preferred that solid electrolytes which are chemically stable, have a high mechanical strength and have a relatively high ionic conductivity at room temperature be chosen and used. In view of the foregoing, use of $Af_3SI$, $Ag_3SBr$, $Cu_2HgI_4$, $Ag_2HGI_4$, $Ag_7I_4PO_4$, $Ag_{19}I_4O_4$, $Ag_2Te_{0.2}$-$S_{0.8}$ or $Ag_2S(0.60)$-$Ag_2HgI(0.40)$ is preferred in the present invention. Even in the case of solid electrolytes which are insufficient in mechanical strength or moisture resistance, if a suitable reinforcement or protective coating is applied, they can be used effectively as electrodes in the present invention.

In the present invention, the above-mentioned Group IB Metal compound solid electrolyte may be shaped into an optional form, for example, a needle, a pen, a pencil, a printing type, a type front, a stamp, a carved seal, a sheet, a drum, a belt or the like. For example, when a recording current is reproduced in the form of an image according to the scanning method, the solid electrolyte is used in the form of a scanning anode, such as a needle, a pen, a pencil or the like. Or if it is used in the form of a supporting anode, such as a sheet, drum or belt supporting on its surface of a recording current, said current is reproduced in the form of an image according to the printing method and the solid electrolyte is used as an anode in the form of a printing type, a type front, a stamp or a carved seal.

These electrodes may be prepared according to various methods chosen appropriately depending on their shapes. For example, scanning electrodes such as needles can be prepared by compression-molding power of a solid electrolyte such as mentioned above into a rod or needle and cutting it according to need, or they can be prepared by filling or melting a solid electrolyte under compression in a sheath having a pencil-like form. In compression molding, metal wires and the like may be used as reinforcers.

A sheet or drum electrode can be prepared by subjecting powder of a solid electrolyte to compression molding processing, and in this case, the powder is molded so that it is integrated with a substrate such as a metal sheet. Further, a sheet or drum electrolyte may be formed by bonding under pressure a compression-body, prepared in advance from powder of a solid electrolyte, to a metal substrate or fuse-bonding such compression-molded body to a metal substrate. Furthermore, a conductive metal such as silver or copper may be vacuum-deposited on the surface of a molded body of a solid electrolyte or a paste or such conductive metal may be coated on the surface of a molded body of a solid electrolyte. If this procedure is adopted, there is attained an advantage that cations of a metal of Group IB of the Periodic Table can be automatically supplied to the electrolyte very conveniently as described hereinafter.

As another method for preparing an anode having a large area, there can be mentioned a method in which a solid electrolyte is vacuum-deposited on a metal substrate or a solid electrolyte is prepared in situ by performing anodic reaction in potassium iodide.

In case a powdery solid electrolyte is subjected to compression molding, in order to obtain a molded body excellent in the mechanical strength, it is necessary that the molding pressure be within the range of from 200 to 5000 $Kg/cm^2$. Of course, when the solid electrolyte to be used is capable of decomposition or melting, it is possible to adopt a method in which it is compression-molded under a relatively low pressure and the molded body is then sintered to obtain an anode excellent in the strength.

Anodes having a form of a printing type, a type front, a carved seal, a stamp or the like may be prepared by casting a solid electrolyte in the molten state or by using the techniques of compression molding and sintering in combination.

In the accompanying drawings:

FIGS. 1-A to 1-H illustrate different embodiments of recording electrodes.

FIG. 11 shows the relationship between recording current and the image density.

FIG. 12 illustrates an arrangement for regeneration of the solid electrolyte.

Several examples of the electric recording electrode (anode) according to the present invention are illustrated in FIGS. 1-A to 1-F. FIG. 1-A shows a needle electrode, FIG. 1-B a pencil type electrode, FIG. 1-C a sheet electrode, FIG. 1-D a drum electrode, FIG. 1-E a belt electrode, and FIG. 1-F shows an electrode having the form of printing type. In these FIGS., A denotes a solid electrolyte of a compound of a metal of Group IB of the Periodic Table and B denotes a substrate of a metal, especially a metal of Group IB of the Periodic Table.

FIGS. 1-G and 1-H illustrate other modifications of the electric recording electrode according to the present invention, namely examples of composite electrodes. In the composite electrode shown in FIG. 1-G, a coating A of a solid electrolyte of a metal of Group IB of the Periodic Table is formed on one side of the periphery of a core C composed of an insulating material and a coating D of a conductive substance such as a metal or carbon is formed on the other side of the periphery of the core C, in such a manner that both the coatings A and B are electrically insulated from each other. When electric recording is conducted by using such composite electrode, the solid electrolyte layer A is used as an anode and the conductive layer B is used as the cathode. When this composite electrode is employed, there is attained an advantage that a recording material free of a conductive layer can be used as the electric recording material, and furthermore, bleeding can be effectively prevented in the resulting recorded image.

These composite electrodes comprising an anode of a solid electrolyte and a cathode of a conductive material, that can be used in the present invention, are not limited to one shown in FIG. 1-G. For instance, a composite electrode comprising, as shown in FIG. 1-H, an anode A composed of a solid electrolyte as a core and a cathode D of a conductive material coated on the anode through an intermediate insulating layer C can be used in the present invention.

The electric recording process of the present invention can be performed according to customary known procedures except that a specific anode such as mentioned above is employed.

Figure 2:
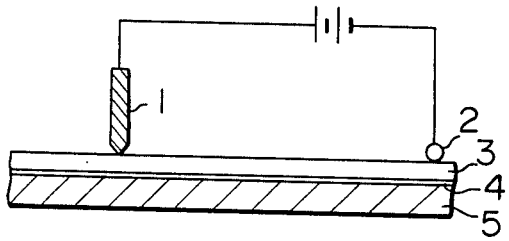

In FIG. 2 illustrating the recording process of the present invention, a recording signal output device is connected to an anode 1 composed of a Group IB Metal compound solid electrolyte and a return electrode 2. An electric recording material is disposed so that its surface has contact with both the anode 1 and return electrode 2. As is shown in FIG. 2, this electric recording material comprises a recording surface layer 3, an intermediate conductive layer 4 and a support 5.

According to the present invention, this recording layer 3 contains a color forming agent capable of reacting with cations of a metal of Group IB of the Periodic Table to form a visible image, and the recording layer has generally a resistance layer than $10^8$ Ω-cm, preferably a resistance lower than $10^7$ Ω-cm.

In the recording process shown in FIG. 2, an electricity conducting passage is formed through the anode 1, the recording layer 3, the conductive layer 4, the recording layer 3 and the return electrode 2, and ions of the metal of Group IB of the Periodic Table are injected into the recording layer 3 from the solid electrolyte anode 1 in correspondence to the intensity of the recording current. Ions of the metal of Group IB thus injected into the recording layer 3 react with a color forming agent to form a visible image. The present invention is characterized in that at this step, recordings of a higher image density can be obtained by recording signals of a smaller electric output than in conventional recording processes utilizing ionic reaction of an electrode.

Figure 10:
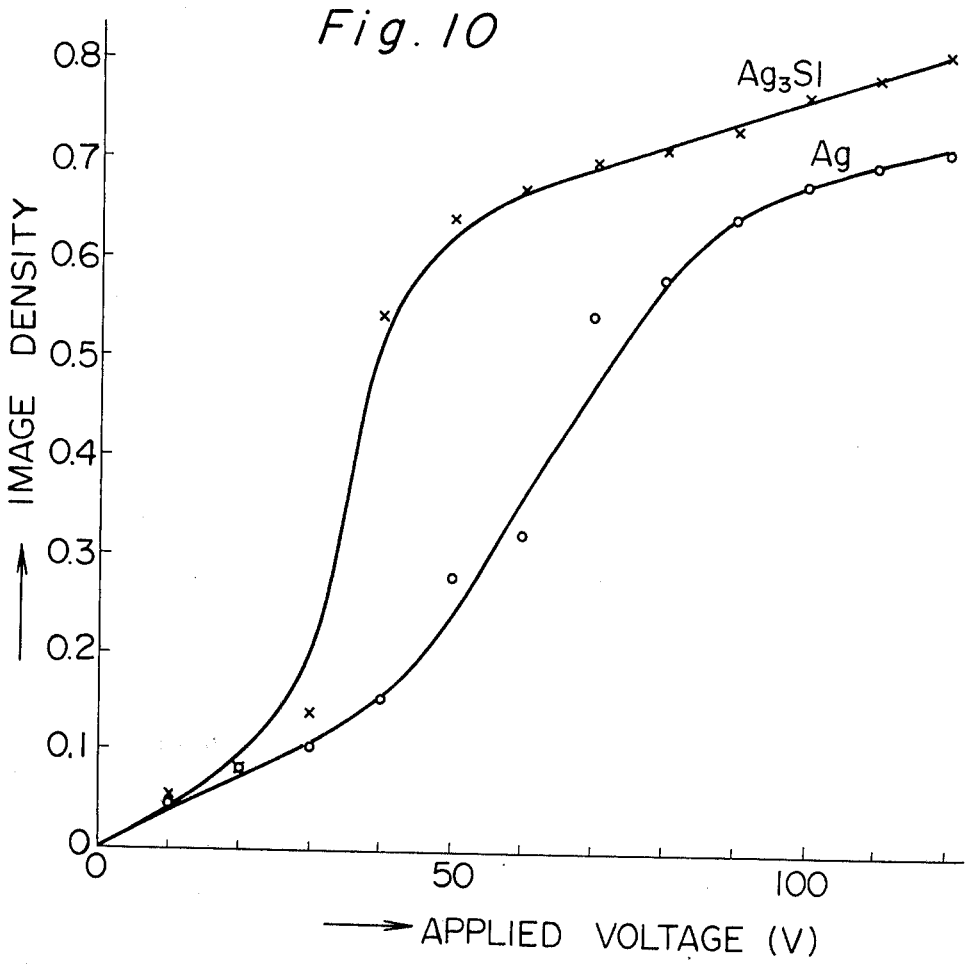
FIG. 10 is a curve showing the effect of voltage on the image density.

FIGS. 10 and 11 are curves showing the relation between the applied voltage and the image density and the relation between the recording current and the image density, which were observed when anodes of metallic silver and of $Ag_3SI$ were used. From these FIGS., the above characteristics of the present invention will readily be understood.

Figure 3:
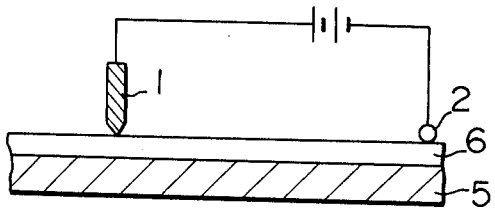

The recording process of the present invention can be applied even to an electric recording material of a two-layer structure. In the recording process shown in FIG. 3, a two-layer laminate structure including a conductive recording layer 6 and a support 5 is employed, and ions of a metal of Group IB of the Periodic Table injected into the conductive recording layer react instantaneously with a color forming agent to form a visible image. It is preferred that the resistance of this conductive recording layer be 10 to $10^5$ Ω-cm.

Figure 4:
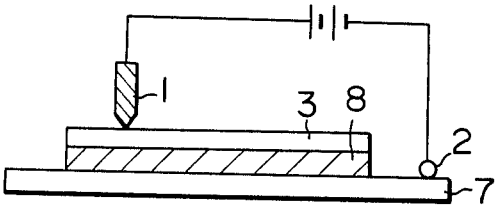

In the recording process shown in FIG. 4, a two-layer laminated recording material including a recording layer 3 and a conductive support 8 is disposed on a back face electrode plate 7.

Figure 5:
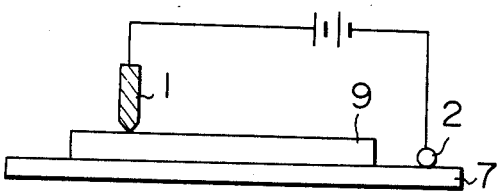

In the recording process shown in FIG. 5, a recording paper 9 impregnated with a color forming agent-containing composition is placed on a back face electrode plate 7. In this case, the recording material can be regarded as having a single layer structure.

Figure 6:
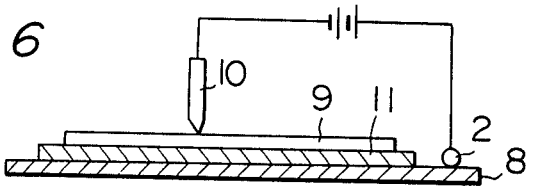
FIGS. 6 to 9 illustrate different recording arrangements for carrying out processes according to the invention.

In the recording process shown in FIG. 6, a sheet anode 11 composed of a solid electrolyte of the present invention is disposed on a conductive support 8 and is used in this state. This sheet anode 11 is connected to the positive side of the recording power source through the conductive support 8 and a return electrode 2. A needle-like cathode 10 is connected to the negative side of the recording power source. A recording paper 9 impregnated with a color forming agent is placed on the sheet anode 11 and the surface of the recording paper 9 opposite to the surface having a contact with the anode 11 is contacted with the needle-like cathode 10, whereby a circuit is formed between the recording paper 9 and the needle-like cathode 10. Cations of a metal of Group IB of the Periodic Table are injected into the recording paper 9 from the sheet anode and a visible image is formed by their reaction with the color forming agent.

Figure 7:
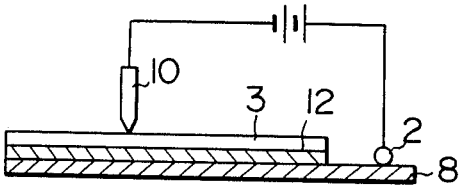

Instead of an anode of a solid electrolyte and a recording layer formed separately, there may be used an integrated assembly of such anode and recording layer. More specifically, in the recording process shown in FIG. 7, a layer 12 of a solid electrolyte of a metal of Group IB of the Periodic Table is integrated with a recording layer 3 containing a color forming agent, and this laminated assembly is used in the same positional relationship as shown in FIG. 6.

Figure 8:
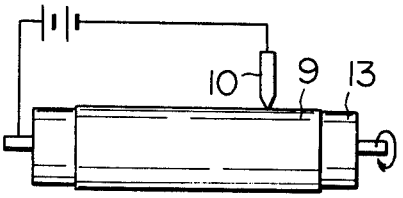

In the recording process shown in FIG. 8, a layer 13 of a solid electrolyte formed on the surface of a metal drum is used as the anode, the electric recording is conducted in the same manner as shown in FIG. 6 while a recording paper 9 is wound on the surface of the drum, namely the anode 13.

Figure 9:
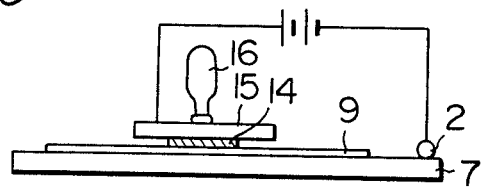

In the recording process shown in FIG. 9, an anode 14 of a printed letter, which is composed of a solid electrolyte of the present invention, is disposed on a suitable metal support 15, and electric recording is conducted in the same manner as shown in FIG. 5. In the embodiment shown in FIG. 9, a grip 16 is disposed to contact the anode 14 of a printed letter with the recording layer 9 and isolate the anode 14 from the recording layer 9. When a type front or a printing type is used as such anode 14, known printing means such as a printing machine or typewriter may be employed.

An optional color forming agent capable of reacting with cations of a metal of Group IB of the Periodic Table to form a visible image is incorporated into the recording layer to be used in the recording process of the present invention.

As the color forming agent, there can be mentioned various reducing agents forming an image by reacting with cations of a metal of Group IB to deposit the metal in the form of fine particles, various chelating agents reacting with cations of a metal of Group IB to form an image of a chelate with the metal of Group IB, and various sulfur-containing compounds forming an image of a sulfide by reacting with cations of a metal of Group IB.

As the reducing agent that can be used as the color forming agent, there can be mentioned inorganic reducing agents such as sodium thiosulfate and sodium sulfite, and organic reducing agents such as hydroquinone, formaldehyde sulfoxylate, protocatechuic acid, spiroindene, 2,3-dihydroxybenzoic acidm catechol, 4-methoxy-1-hydroxynaphthalene, chlorohydroquinone and Metol. These reducing agents are especially effective for forming images by reduction of silver ions.

As the chelating agent that can be used as the color forming agent, there can be mentioned, for example, thionalide, mercaptophenylthiothiadiazolone, 2,9-dimethyl-1,10-phenanthroline, neocupferron, bismuthiol II, phenylthiohydantoic acid, 3-methyl-1-phenyl-5-pyrazolone, 2-mercaptobenzothiazole, oxine, galoylgallic acid, cuproine, sodium diamine tetracetate, glyoxal-bis(2-hydroxyanil), sodium diethyl dithiocarbamate and rubeanic acid. These chelating agents are especially effective when ions of a metal of Group IB are copper ions.

The following compounds can be mentioned as the color forming agent of the sulfur compound type capable of providing a sulfide image by reaction with a metal of Group IB of the Periodic Table.

1. Thiosulfates, such as ammonium thiosulfate, sodium thiosulfate, potassium thiosulfate, calcium thiosulfate, barium thiosulfate, strontium thiosulfate, lead thiosulfate and mgnesium thiosulfate.

2. Thiourea derivatives which are represented by the following general formula:

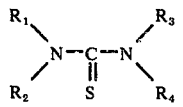

wherein $R_1$, $R_2$, $R_3$ and $R_4$, which may be the same or different, stand for a hydrogen atom, an alkyl group, an aryl group, an aralkyl group or a heterocyclic residue, these substituents may be further substituted, and $R_1$ and $R_2$ or $R_3$ and $R_4$ may form a heterocyclic ring together with the nitrogen atom. A specific examples of such thiourea derivative, there can be mentioned thiourea, N-methyl-thiourea, N-ethylthiourea, N-phenylthiourea, N,N-diphenylthiourea, N-phenyl-N,N'-dimethyl-thiourea, N-methoxyphenylthiourea, N-phenyl-N'-benzylthiourea, N-phenyl-N'-octadecylthiourea, N-phenyl-N'-(p-dimethylaminophenyl)thiourea, N-(p-tolyl)-N'-cyclohexylthiourea, N-(p-methoxyphenyl)-N'-allylthiourea, N-phenyl-N'-benzoylthiourea, N-(m-chlorophenyl)-N'-phenylthiourea, N-(β-naphthyl)-N,N'-pentamethylenethiourea, N-hexamethylene-bis(N'-phenyl)thiourea, N,N'-bis(dimethylaminophenyl)thiourea and N,N'-ethylenethiourea.

3. Thioamide derivatives represented by the following general formula

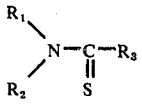

wherein $R_1$ and $R_2$, which may be the same or different, stand for a hydrogen atom, an amino group, an alkyl group, an aryl group or a heterocyclic organic compound residue, $R_3$ stands for a hydrogen atom, an amino group, a carboxyl group, a mercapto group, an alkyl group, an aryl group or a heterocyclic organic compound residue, these residues may be further substituted, and two of $R_1$, $R_2$ and $R_3$ may form a heterocyclic ring together with the nitrogen atom. As specific examples of such thioamide derivative, there can be mentioned thioformamide, thioacetamide, thiopropionamide, thiostearamide, thiobenzamide, thioformanilide, thioacetanilide, thioacetonaphthalide, thiobenzanilide, thiooxamide, thiosemicarbazide, 4-a;llylthiosemicarbazide, 4-phenylthiocarbazide, methylethylketone-thiosemicarbazone, cyclohexanone-thiosemicarbazone, benzaldehyde-thiosemicarbazone, hydrazine-bis-thiocarbonamide, thiocarbazide, N,N,N',N'-tetramethyl-thiuram disulfide and ammonium N-methyldithiocarbamate.

4 Other sulfur-containing compounds such as ammonium thiocyanate, sodium thipphosphate, potassium tetrathionate and barium tetrathionate.

For these sulfur-containing compounds, it is preferred that the recording operation be conducted under heating, because sulfur or hydrogen sulfide is effectively formed from these sulfur-containing compounds under heating. Accordingly, it is advantageous to use these sulfur-containing compounds in combination with anodes of solid electrolytes of the high temperature type.

As pointed out hereinbefore, the recording layer to be used in the present invention preferably has a volume resistivity lower than $10^8$ Ω-cm, especially a volume resistivity of from 10 to $10^7$ Ω-cm. When the electric resistance of the recording layer is higher than the above range, a conductivity sufficient to release cations of a metal of Group IB of the Periodic Table onto the recording layer cannot be obtained. In contrast, when the electric resistance is lower than the above range, tendency towards bleeding in the resulting image is increased.

In order to adjust the electric resistance of the recording layer within the above-mentioned preferred range, it is desired that an inorganic or organic conducting agent be incorporated into the recording layer.

Various organic and inorganic conducting agents, for example, those exemplified below, can be used in the present invention as such conducting agent.

A. Inorganic Conducting Agents:

Potassium chloride, barium chloride, magnesium chloride, zinc chloride, aluminum chloride, ammonium chloride, calcium chloride, potassium bromide, sodium bromide, zinc bromide, aluminum sulfate, magnesium sulfate, potassium sulfate, barium sulfate, sodium sulfate, ammonium sulfate, sodium sulfite, aluminum nitrate, ammonium nitrate, barium nitrate, zinc nitrate, calcium nitrate, sodium nitrate, sodium nitrite, ammonium acetate, potassium acetate, calcium acetate, lead acetate, sodium acetate, ammonium carbonate, potassium carbonate, sodium carbonate, calcium carbonate, sodium ortho-phosphate, cuprous iodide, stannic oxide and indium (III) oxide.

B. Organic Conducting Agents:

1. Cationic Conducting Agents:

1-*a* Amine Type Conducting Agents:

Primary, secondary and tertiary alkylamines, cycloalkylamines and alkanolamines, their acid addition salts with carboxylic acids, phosphoric acid or boric acid, and polyalkyleneimines, amideamines and polyamines and their complex metal salts.

1-b. Imidazoline Type Conducting Agents:

1-Hydoxethyl-2-alkylimidazolines and the like.

1-c. Amine-Ethylene Oxide Adducts and Amine-Propylene

Oxide Adducts:

Adducts of ethylene oxide, propylene oxide or other alkylene oxide to mono- or di-alkanolamines, long-chain ( $C_{12}$ to $C_{22}$ ) alkylamines or polyamines.

1-d. Quaternary Ammonium Salts:

Quaternary ammonium salts represented by the following general formula:

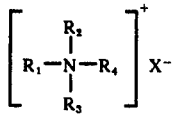

wherein $R_1$ to $R_4$, which may the same or different, stand for an alkyl group with the proviso that at least 2 of $R_1$ to $R_4$ stand for a lower alkyl group and at least one of $R_1$ to $R_4$ stands for an alkyl group having at least 6 carbon atoms, preferably at least 8 carbon atoms, and X denotes a halide ion, and quaternary ammonium salts represented by the following general formula:

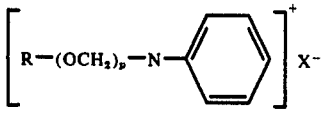

wherein R stands for an alkyl group having at least 12 carbon atoms, p is 0 or 1, and X stands for a halide ion.

1-e. Other Cationic Conducting Agents:

Cationic polymers formed by quaternizing polymers of aminoalcohol esters of ethylenically unsaturated carboxylic acids ( such as a quaternary ammonium type polymer of diethylaminoethyl methacrylate ), acrylamide derivatives ( such as a quaternary ammonium type polymer of N,N-diethylaminoethyl acrylamide), vinyl ether derivatives (such as a pyridium salt of polyvinyl-2-chloroethyl ether), nitrogen-containing vinyl derivatives (such as a product formed by quaternizing poly-2-vinylpyridine with p-toluenesulfonic acid), polyamine resins (such as polyethylene glycol polyamine), and polyvinylbenzyltrimethyl ammonium chloride.

2. Anionic Conducting Agents:

2-a. Sulfonic Acid Type Conducting Agents:

Alkylsulfonic acids, sulfated oils, and salts of higher alcohol sulfuric acid esters.

2-b. Carboxylic Acid Type Conducting Agents:

Adipic acid and glutamic acid.

2-c. Phosphoric Acid Derivative Conducting Agents:

Phosphonic acid, phosphinic acid, phosphite esters and phosphate ester salts.

2-d. Other Anionic Conducting Agents:

Homopolymers and copolymers of ethylenically unsaturated carboxylic acids (such as polyacrylic acid and copolymers of maleic anhydride with comonomers such as styrene and vinyl acetate), and homopolymers and copolymers of sulfonic acid group-containing vinyl compounds (such as polyvinyltoluenesulfonic acid and polystyrenesulfonic acid).

3. Non-Ionic Conducting Agents:

3-a. Polyether Type Conducting Agents:

Polyethylene glycol and polypropylene glycol.

3-b. Alkylphenol Adduct Type Conducting Agents:

Adducts of ethylene oxide or propylene oxide to alkylphenols.

3-c. Alcohol Adduct Type Conducting Agents:

Adducts of ethylene oxide or propylene oxide to alcohols (such as a higher alcohol-ethylene oxide adduct).

3-*d*. Ester Type Conducting Agents: Butyl, amyl and glycerin esters of higher fatty acids such as adipic acid and stearic acid.

3-*e*. Amide Type Conducting Agents:

Higher fatty acid amides, dialkyl amides, and adducts of ethylene oxide or propylene oxide to these amides.

3-f. Polyhydric Alcohol Type Conducting Agents:

Ethylene glycol, propylene glycol, glycerin, pentaerythritol and sorbitol.

4. Amphoteric Conducting Agents:

Betain type conducting agents, imidazoline type conducting agents and aminosulfonic acid type conducting agents.

Conducting agents exemplified above may be used singly or in the form of a mixture of two or more of them. For example, better results are obtained when inorganic conducting agents are used in combination with organic conducting agents capable of acting as binders. In the present invention, it is generally preferred that among the foregoing conducting agents, a cationic polymeric conducting agent or an anionic polymeric conducting agent be chosen and used.

As a resinous binder that can be used in combination with a conducting agent as exemplified above, there can be mentioned, for example, natural binders such as casein, modified casein, starch and cyanoethylated starch, and synthetic resin binders such as vinyl acetate resins, polyvinyl alcohol resins, saponified vinyl acetate resins differing in the degree of saponification, modified vinyl acetate resins, polyvinyl acetal resins, partially butylated polyvinyl acetal resins and acrylic resins. These binders may be used in the form of an aqueous solution or organic solvent solution or an emulsion or dispersion.

In order to improve characteristics such as opacity, whiteness and contrast, it is possible to incorporate in the recording layer to be used in the present invention a white pigment such as titanium oxide and zinc oxide and an extender pigment such as magnesium oxide, calcium carbonate, clay, silica and alumina powder.

Still further, in order to tone the formed image, it is possible to incorporate into the recording layer a compound capable of forming a color by anodic oxidation. For example, when a leuco dye such as Leucomethylene Blue, Benzoyl Leucomethylene Blue, Leucomethylcapryl Blue, Leucoethyl Nile Blue, leuco-indigosulfonic acid or the like is incorporated into a layer of the color forming agent, there are simultaneously formed a color image from cations of a metal of Group IB of the Periodic Table and a colored image by anodic oxidation of the leuco dye, and as a result, a toned recorded image can be obtained.

In the case of a solid electrolyte electrode having a high ionic conductivity at room temperature, if an organic reducing agent or organic chelating agent is incorporated into a recording paper or recording layer, a colored recorded image including a metal image or chelate image can be obtained. In case an $\alpha$-type high temperature-conductive solid electrolyte is used as the electrode, if a compound capable of releasing water of crystallization or sulfur or hydrogen sulfide under heating is incorporated into a recording paper or a recording layer, a metal image, a chelate colored image or a metal sulfide image can be formed according to the intensity of the recording current simultaneously when the solid electrolyte electrode heated at a temperature exceeding the transition point thereof is contacted with the color forming agent of the recording layer.

As the compound capable of releasing water of crystallization, that can be used in the above embodiment, there can be mentioned, for example, magnesium hydroxide, bismuth hydroxide, aluminum hydroxide, formyl chloride hexahydrate, magnesium chloride hexahydrate, magnesium ammonium chloride hexahydrate, zinc sulfate hexahydrate, aluminum ammonium sulfate dodecahydrate, aluminum sodium sulfate dodecahydrate, magnesium potassium sulfate chloride, ferric sulfate nonahydrate, ferric ammonium sulfate dodecahydrate and magnesium ammonium sulfate hexahydrate.

A composition comprising the above-mentioned color forming agent and conducting agent is applied to a substrate for electric recording according to a known method. As the substrate, there can be used, for example, paper, woven fabrics, non-woven fabrics, plastic films, matted films, metal foils, metal vacuum-deposited films and glass sheets. When fibrous substrates such as paper, woven fabrics and non-woven fabrics are employed, a recording layer can be formed on such substrate only by impregnating the substrate with the above composition. In the case of other substrates, a recording layer is formed by coating the above composition including a conducting agent capable of acting as a binder or other binder additionally incorporated.

In the present invention, the amount of the color forming agent is not particularly critical as far as the amount is such that an image of a high density can be formed simultaneously with injection of cations of a metal of Group IB of the Periodic Table. In the case of a color forming agent of the reducing agent type, however, it is preferred that the amount applied be 0.5 to 20 g/m$^2$, especially 0.5 to 10 g/m$^2$ in the case of impregnation and 1 to 20 g/m$^2$ in the case of coating. When a chelating compound is used as the color forming agent, it is preferred that the color forming agent be applied to the substrate in an amount of 0.5 to 20 g/m$^2$, especially 0.5 to 10 g/m$^2$ in the case of impregnation and 1 to 20 g/m$^2$ in the case of coating. In case a sulfur-containing compound is used as the color forming agent, it is preferred that the compound be applied to the substrate in an amount of 1 to 20 g/m$^2$, especially 1 to 10 g/m$^2$ in the case of impregnation and 2 to 20 g/m$^2$ in the case of coating.

In case an $\alpha$-type high temperature-conductive electrolyte is used as the anode under heating, it is preferred that a compound capable of releasing water of crystallization, such as exemplified above, be incorporated in the recording layer in an amount applied of 2 to 30 g/m$^2$, especially 2 to 10 g/m$^2$ in the case of impregnation and 5 to 30 g/m$^2$ in the case of coating.

When the impregnation method is adopted, it is preferred that an organic or inorganic conducting agent having a relatively low molecular weight be applied in an amount selected from a range of 5 to 20 g/m$^2$ such that the electric resistance of the resulting recording layer is not higher than $10^8$ Ω-cm. When the coating method is adopted, it is preferred that a highly polymeric conducting agent be used singly also as the binder or in combination with other binder or a low-molecular-weight organic conducting agent or inorganic conducting agent, or that a low-molecular-weight organic conducting agent and an inorganic conducting agent be used in combination with a binder such as mentioned above. In this case, the amount applied of the conducting agent is preferably adjusted within a range of 1 to 40 g/m$^2$, and when a conductive substrate is employed, the amount of the conducting agent is preferably 1 to 10 g/m$^2$ and when a non-conductive substrate is used, the amount of the conducting agent is preferably 5 to 40 g/m$^2$.

The recorded image formed according to the process of the present invention may be further processed by various post-treatments, whereby the image density or contrast can optionally be heightened or reduced. For example, when an image of metal particles formed by using a recording layer comprising a reducing agent as the color forming agent is subjected to such post-treatment as non-electrolytic plating, the metal particle image can be amplified. In this case, a non-electrolytic plating bath containing a water-soluble silver salt such as silver nitrate and silver potassium cyanide, a reducing compound (reducing agent) such as sodium hypophosphite, anhydrous sodium sulfite, formalin and hydroquinone, or a buffering agent such as a formate and an acetate is preferably employed, and a recording material carrying thereon a metal particle image is immersed in such bath until a desired amplified metal image is formed.

The ionic conductivity of an anode composed of the solid electrolyte according to the present invention is gradually reduced by release of ions of the metal of Group IB of the Periodic Table while it is being used, and after it has been used for a long time, it becomes difficult for the anode to exhibit a sufficient image-forming capacity. According to the present invention, replenishment of ions of the metal of Group IB of the Periodic Table or regeneration of the anode can readily be accomplished.

For example, when the anode member composed of the solid electrolyte is contacted with a Group 1B metal corresponding to the cation of the electrolyte and a current is applied to as the anode, cations of the metal of Group IB are injected into the solid electrolyte and the anode member is regenerated. Further, if a Group IB metal which corresponds to the cation of A; the solid electrolyte is closely contacted with the solid electrolyte in advance by vacuum deposition or press bonding, and an electric current is applied to the metal of Group IB, the metal ions flow in the direction of the electric current to regenerate the solid electrolyte anode. More specifically, in electrodes shown in FIGS. 1-A to 1-F, when a substrate composed of the Group IB metal corresponding to the cation of a solid electrolyte A is used as the metal substrate B and a lead-in wire is connected to the metal substrate B for passing a recording current therethrough, injection of the metal of Group IB into the solid electrolyte A is accomplished simultaneously with release of ions of the metal of Group IB from the electrolyte A under application of the recording current. In this embodiment, there can be thus attained an advantage that a particular regeneration operation need not be conducted at all. Of course, it is possible to perform regeneration of the electrode member by fixing the electrode member onto a plate or powder of the same metal as the metal of the electrode member and an electric current is passed. therebetween with the electrode member being on the negative side and the metal plate or powder being on the positive side while the recording is stopped.

Still further, regeneration of the solid electrolyte of the present invention by replenishment of the metal of Group IB can be accomplished by utilizing the principle of a so-called Galvanic cell. An embodiment of this regeneration method is illustrated in FIG. 12. Referring now to FIG. 12, an anode member A composed of $\alpha$-$Ag_2Se$ includes a bottom portion 17 and a recording needle 18. A layer 20 of metallic silver is formed on one surface of the bottom portion 17 through a layer 19 composed of $\alpha$-AgI, and a layer 21 of platinum is formed on the other surface of the bottom portion 17. Thus, a cell having a structure represented by the following formula:

$$\oplus Ag|\alpha\text{-}AgI|\alpha\text{-}Ag_2Se|Pt\ominus$$

is formed with the anode A intervening therebetween. This integrated cell is contained in a ceramic protective tube 22, and an electric heating mechanism 23 such as a nichrome wire. While the recording is stopped, electricity is applied to the cell in the state where the silver electrode 20 is connected to the positive side of a power source and the platinum electrode 21 is connected to the negative side of the power source, and simultaneously, the cell system is heated by the electric heating mechanism 23, whereby injection of silver into $\alpha$-$Ag_2Se$ can be accomplished with high efficiency. In addition to $\alpha$-$Ag_2Se$, there may be similarly employed $\alpha$-$Ag_2S$, $\alpha$-$Ag_2Te$ and silver chalcogen as the anode A. In this embodiment, the electric heating mechanism 23 has also a function of maintaining the anode A at a prescribed level during the recording operation.

Replenishment of ions of a metal of Group IB of the Periodic Table may also be accomplished by the known method utilizing the difference in electrodynamic potential.

The recording process of the present invention can be used broadly in various fields for indicating or reproducing outputs in facsimile, electronic computors, teletypes, automatic ticket venders and the like.

The present invention will now be described in detail by reference to the following Examples which by no means limit the scope of the invention.

REFERENTIAL EXAMPLE 1

Synthesis of $Ag_3SI$:

An equimolar mixture of $Ag_2S$ and AgI was blended and pulverized in a mortar, and the pulverized mixture was charged in vacuo into a quartz tube together with a small amount of sulfur and heated at 550° C. for about 17 hours. Then, the reaction product was cooled and withdrawn from the tube to recover a compound in the form of a black mask.

REFERENTIAL EXAMPLE 2

Synthesis of $Ag_2HgI_4$:

A solution of 8.3 g of KI in 50 m*l* of water was added to 6.8 g of $HgI_2$ to dissolve $HgI_2$ in the solution, and the resulting solution was further mixed with a solution of 8.3 g of KI in 50 m*l* of water. The mixture was filtered, and when 5.1 g of $AgNO_3$ was added to the filtrate, a yellow precipitate was immediately formed. The precipitate was recovered by filtration, washed with water and dried at room temperature to obtain about 13.5 g of $Ag_2HgI_4$.

REFERENTIAL EXAMPLE 3

Synthesis of $Cu_2HgI_4$:

Procedures of Referential Example 1 were repeated in the same manner except that a solution of 12 g of $CuSO_4 \cdot 5H_2O$ in 50 ml of water was added instead of $AgNO_3$ and sufficient $SO_2$ gas was passed through the reaction mixture. The resulting red precipitate was recovered by filtration, washed with water and dried at room temperature to obtain about 12.3 g of $Cu_2HgI_4$.

EXAMPLE 1

A mixture comprising 60 parts by weight of titanium oxide, 150 parts by weight of Cogum HW-7 (42% aqueous solution of a water-soluble acrylic resin manufactured by Showa Kobunshi K, K.), 90 parts by weight of Chemistat (30% aqueous solution of a conductive resin manufactured by Sanyo Kasei Kogyo K. K.), 6 parts by weight of hydroquinone, 4.5 parts by weight of sodium sulfite, 10 parts by weight of sodium nitrate, 350 parts of water and 50 parts by weight of methanol was blended and dispersed for 2 hours in a ball mill, and the resulting dispersion was coated on an aluminum-vacuum-deposited film by means of a wire bar. Then, the coated dispersion was dried to form a recording layer having a thickness of 10 $\mu$ on the film. Recording was conducted at a scanning speed of 10 cm/sec and a needle pressure of 10 g by using the so formed recording material and applying a voltage of 0 to + 120 V to a needle electrode and a back face electrode, to obtain results shown in FIGS. 10 and 11. As the needle electrodes, there were used a silver needle electrode of a diameter of 0.5 mm and a solid electrolyte needle electrode of $Ag_3SI$ having a diameter of 0.7 mm. The solid electrolyte needle electrode had a length of 4.5 mm and a resistance of $9 \times 10^3\ \Omega$.

As is seen from the results shown in FIGS. 10 and 11, the $Ag_3SI$ needle electrode provided a recorded image of a higher density at a lower voltage and a lower current than the silver needle electrode. For determination of the image density, there was employed Sakura Microdensitometer Model PDM-5 (manufactured by Konishiroku Shashin Kogyo K. K.).

EXAMPLE 2

In preparing a coating composition in the same manner as described in Example 1, 20 parts by weight of sodium thiosulfate was added instead of hydroquinone to improve the electric resistance and reducing characteristic. A recording material was prepared in the same manner as described in Example 1 by using the so formed coating composition. The recording material was attached to Gakken Fax (manufactured by Gakushu Kenkyusha K. K.) and recording was conducting by sending recording signals at a speed of 2.0 m/sec. When a silver needle electrode as described in Example 1 was employed, the density of the recorded image was 0.4. In contrast, when a needle electrode of $Ag_3SI$ as described in Example 1 was used according to the present invention, the density of the recorded image was as high as 0.8.

EXAMPLE 3

$Ag_2HgI_4$ powder was molded into tablets under pressure of about 500 Kg/cm$^2$ by using a tablet molding machine, and the tablets were cut by a fret saw and were then filed to obtain needle electrodes having a diameter of 1 mm and a length of 4 mm.

A reducing agent solution comprising 5 parts by weight of water-soluble sodium formaldehyde-sulfoxylate, 11 parts by weight of potassium nitrate, 2 parts by weight of sodium titanate and 82 parts of water was impregnated in a base paper for diazo-type photography, and the impregnated base paper was dried at room temperature to obtain a recording paper. A silver lead-wire was attached to the above $Ag_2HgI_4$ needle electrode and the electrode was fixed in a nichrome wire-wound ceramic protective tube maintained at 55° C., and the above recording paper was fixed onto a counter electrode. In this state, electricity was applied and the recording was conducted with a recording voltage of + 80 V, a needle pressure of 10 g and a scanning speed of 50 cm/sec. As a result, there was obtained a bleed-free recorded image having a density of 1.0.

EXAMPLE 4

Recording was conducted on the recording paper prepared in Example 3 by using the same electrode as used in Example 1 until no recorded image was obtained. As soon as silver ions were consumed, it became impossible to obtain a recorded image, although the density in resulting silver particle images was not changed at all throughout the recording operation. Then, the $Ag_3SI$ electrode and silver plate were connected so that the needle electrode acted as a cathode and the silver plate acted as an anode, and a voltage of 40 V was applied for 5 minutes to effect replenishment of silver ions. When recording was conducted again by using the thus regenerated electrode, the recorded images had a density as high as the density in the previously obtained recorded images.

EXAMPLE 5

A mixture comprising 60 parts by weight of titanium oxide, 30 parts by weight of calcium thiosulfate, 10 parts by weight of sodium thiosulfate, 10 parts of sodium nitrate, 200 parts by weight of Slec W (25% aqueous solution of a water-soluble acetal resin manufactured by Sekisui Kagaku Kogyo K. K.), 160 parts by weight of Chemistat (47% aqueous solution), 200 parts by weight of methanol and 250 parts by weight of water was blended and dispersed in a ball mill for 2 hours, and the dispersion was coated and dried on an aluminum-vacuum-deposited film to obtain a recording material.

Recording was conducted under conditions of a recording voltage of + 80 V, a needle pressure of 10 g and a scanning speed of 50 cm/sec by using the thus prepared recording material and a $Cu_2HgI_4$ needle electrode maintained at 70° C. As a result, there was obtained a blackish brown recorded image having a density of 0.9.

EXAMPLE 6

In the same manner as described in Example 1, a recording material was prepared by using 60 parts by weight of bismuth hydroxide instead of titanium oxide. A printing letter type electrode of $Ag_2S$ maintained at 190° C. was pressed to the so prepared recording material and a recording voltage of + 40 V was applied to obtain a blackish brown image reproducing faithfully the letter pattern and having a density of 1.1.

EXAMPLE 7

A recording paper prepared in the same manner as described in Example 3 was allowed to stand for 20 hours in an atmosphere of a relative humidity of 35%. The volume resistivity of the recording paper was $3 \times 10^{10}\ \Omega$ after this treatment. The recording paper was spread on a metal drum, and recording was conducted under conditions of an applied voltage of + 100 V, a needle pressure of 10 g and a scanning speed of 2 m/sec by using a silver needle electrode or $Ag_3SI$ needle electrode as the anode. When the $Ag_3SI$ needle electrode was employed, images having a density of 0.5 was obtained, whereas the density of images obtained by using the silver needle electrode was 0.1. Thus, it was confirmed that the needle electrode of the present invention can be used effectively even under conditions of low humidity.

EXAMPLE 8

A mixture comprising 60 parts by weight of stannic oxide, 170 parts by weight of Kogum HW-7, 100 parts by weight of Chemistat 6120, 50 parts by weight of rubeanic acid, 70 parts by weight of ferric ammonium sulfate dodecahydrate, 10 parts by weight of ammonium nitrate, 400 parts by weight of water and 100 parts by weight of methanol was blended and dispersed for 3 hours in a ball mill, and the resulting dispersion was coated and dried on an aluminum-laminated paper to form a recording material. A $Cu_2HgI_4$ printing letter type electrode maintained at 70° C. was used as an anode and was pressed to the above recording material under application of a recording voltage of 50 B. As a result, a blackish green pattern having a density of 1.2 was formed on a ground of a light scarlet color.

What we claim is:

1. An electric recording process comprising applying electricity to an anode comprising a solid electrolyte, said electrolyte being a compound of a metal of Group IB of the Periodic Table and said electrolyte having an ionic conductivity of at least $1 \times 10^{-4}\ \Omega^{-1}cm^{-1}$ under application conditions, said anode contacting a recording layer containing color forming agent capable of reacting with ions of said metal of Group IB of the Periodic Table to form a visible image.

2. A recording process according to claim 1 wherein the solid electrolyte is a halide or chalcogenide of a metal Group IB of the Periodic Table, a solid solution thereof, a solid solution thereof with a halide or chalcogenide of other metal or a solid solution thereof with another salt of the metal of Group IB of the Periodic Table.

3. A recording process according to claim 1 wherein the solid electrolyte has an ionic conductivity of at least $1 \times 10^{-3}\ \Omega^{-1}\ cm^{-1}$ under application conditions.

4. A recording process according to claim 1 wherein the solid electrolyte is a solid electrolyte of a silver compound.

5. A recording process according to claim 1 wherein the solid electrolyte is a solid electrolyte of a copper compound.

6. A recording process according to claim 1 wherein the solid electrolyte has an ionic conductivity of at least $1 \times 10^{-4}\ \Omega^{-1}cm^{-1}$ at room temperature.

7. A recording process according to claim 6 wherein the solid electrolyte is $Ag_3SBr$ or $AG_3SI$.

8. A recording process according to claim 6 wherein the solid electrolyte is $Ag_7I_4PO_4$, $Ag_{19}I_{15}P_2O_7$ or $Ag_6I_4.WO_4$.

9. A recording process according to claim 6 wherein the solid electrolyte is $Ag_2Te_{0.2}S_{0.8}$.

10. A recording process according to claim 1 wherein the solid electrolyte has a transition point higher than room temperature but lower than 200° C. and has an ionic conductivity of at least $1 \times 10^{-4}\ \Omega^{-1}cm^{-1}$ at a temperature higher than said transition point.

11. A recording process according to claim 10 wherein the solid electrolyte is $Ag_2HgI_4$ and $Cu_2HgI_4$.

12. An electric recording process comprising locating, between an anode comprising a solid electrolyte of a compound of a metal of Group IB of the Periodic Table, said electrolyte having an ionic conductivity of at least $1 \times 10^{-4}\ \Omega^{-1}cm^{-1}$ at a temperature ranging from room temperature to 200° C., and a cathode, a recording layer containing a color forming agent capable of reacting with ions of said metal of Group IB of the Periodic Table to form a visible image, in such a manner that the recording layer is contacted with the anode, to thereby form an electricity conducting passage between said anode and said cathode, and applying an electric voltage between said anode and said cathode to thereby inject ions of said metal of Group IB of the Periodic Table into said recording layer and form a visible image by reaction of said ions with the color forming agent in said recording layer.

13. A recording process according to claim 12 wherein the recording layer has a volume resistivity not higher than $10^8\ \Omega$-cm.

14. A recording process according to claim 12 wherein the color forming agent is an inorganic or organic reducing agent, and said color forming agent is reacted with ions of the metal of Group IB of the Periodic Table to precipitate said metal in the form of fine particles and form a visible image of fine particles of said metal.

15. A recording process according to claim 12 wherein the color forming agent is a chelating agent and said color forming agent is reacted with ions of the metal of Group IB of the Periodic Table to form a visible image of a chelate of said metal.

16. A recording process according to claim 12 wherein the color forming agent is a sulfur compound capable of reacting with ions of the metal of Group IB of the Periodic Table to form a visible image of a sulfide.

17. A recording process according to claim 12 wherein the solid electrolyte has a transition point higher than room temperature but lower than 200° C. and has an ionic conductivity of at least $1 \times 10^{-4}\ \Omega^{-1}cm^{-1}$ at a temperature higher than said transition point, said recording layer contains an inorganic compound capable of releasing water of crystallization or water of hydration under heating, and the anode heated at a temperature higher than said transition point of the solid electrolyte is contacted with the recording layer.

18. An electric recording process comprising locating, between a composite anode including a solid electrolyte of a compound of a metal of Group IB of the Periodic Table having an ionic conductivity of at least $1 \times 10^{-4}\ \Omega^{-1}cm^{-1}$ and a metal substrate composed of the same metal as the metal of said solid electrolyte and a cathode, a recording layer containing a color forming agent capable of reacting with ions of said metal of Group IB of the Periodic Table to form a visible image, in such a manner that said recording layer is contacted with said solid electrolyte, to thereby form an electricity conducting passage between said anode and said cathode; applying an electric voltage between said anode and said cathode to thereby inject ions of said metal of Group IB of the Periodic Table from the solid electrolyte into said recording layer and form a visible image by reaction of said ions with the color forming agent; and simultaneously supplying ions of the metal of Group IB into the solid electrolyte to said metal substrate.

19. A recording process according to claim 18 wherein said composite anode is a needle having a top portion composed of said solid electrolyte and an electric voltage is applied between the anode and the cathode while scanning said needle anode and the recording layer relatively to each other.

20. A recording process according to claim 18 wherein said cathode is a needle electrode, said composite anode is a sheet-like or drum-like electrode in which the surface to be contacted with the recording layer is composed of said solid electrolyte, and an electric voltge is applied between the anode and the cathode while scanning said needle cathode and the recording layer relatively to each other.

* * * * *

UNITED STATES PATENT AND TRADEMARK OFFICE

CERTIFICATE OF CORRECTION

PATENT NO. : 4,035,244

DATED : July 12, 1977

INVENTOR(S) : Eiichi Inoue, Hiroshi Kokado and Nobuhiro Miyakawa

It is certified that error appears in the above-identified patent and that said Letters Patent are hereby corrected as shown below:

Page 1, first column, after "[75] Inventors:", the last name of the first inventor should read -- Inoue --.

Signed and Sealed this

*Fourth* Day of *October 1977*

[SEAL]

*Attest:*

RUTH C. MASON
*Attesting Officer*

LUTRELLE F. PARKER
*Acting Commissioner of Patents and Trademarks*